US009419331B1

(12) United States Patent
Kraige et al.

(10) Patent No.: US 9,419,331 B1
(45) Date of Patent: Aug. 16, 2016

(54) FLEXIBLE ANTENNA WITH WEATHERPROOF PROTECTION SYSTEM AND METHOD OF WEATHER PROOFING AND ADDING A FLEXIBLE FEATURE TO EXISTING ANTENNAS

(71) Applicants: David R. Kraige, State College, PA (US); Jacob J. Loverich, State College, PA (US); Stephen J. Wenner, Port Matilda, PA (US)

(72) Inventors: David R. Kraige, State College, PA (US); Jacob J. Loverich, State College, PA (US); Stephen J. Wenner, Port Matilda, PA (US)

(73) Assignee: KCF Technologies, Inc, State College, PA (US)

( * ) Notice: Subject to any disclaimer, the term of this patent is extended or adjusted under 35 U.S.C. 154(b) by 409 days.

(21) Appl. No.: 14/142,109

(22) Filed: Dec. 27, 2013

(51) Int. Cl.
*H01Q 1/40* (2006.01)
*H01Q 1/42* (2006.01)

(52) U.S. Cl.
CPC ..... *H01Q 1/40* (2013.01)

(58) Field of Classification Search
CPC ..... H01Q 1/40
USPC ..... 343/872, 873
See application file for complete search history.

(56) References Cited

U.S. PATENT DOCUMENTS 3,442,476 A * 5/1969 Trimble ..... H01Q 1/106 248/205.9
3,725,944 A * 4/1973 Valeriote, Jr. ..... H01Q 9/30 343/873
6,046,708 A * 4/2000 MacDonald, Jr. ..... H01Q 1/244 343/872
6,061,036 A * 5/2000 MacDonald, Jr. ..... H01Q 1/243 343/702
6,259,411 B1 * 7/2001 Yanagisawa ..... H01Q 1/085 343/712
2004/0189543 A1 * 9/2004 Jordan ..... H01Q 1/085 343/900
2008/0062067 A1 * 3/2008 Cislo ..... H01Q 1/40 343/872
2009/0051608 A1 * 2/2009 Johnson ..... H01Q 1/1242 343/713
2010/0001910 A1 * 1/2010 Kawaguchi ..... H01Q 1/3275 343/711
2014/0015717 A1 * 1/2014 Kowalewicz ..... H01Q 1/3275 343/715
2015/0241463 A1 * 8/2015 Kraige ..... G01H 5/00 73/514.29
2015/0276441 A1 * 10/2015 Kraige ..... G01F 1/46 73/861.42

* cited by examiner

*Primary Examiner* — Graham Smith
(74) *Attorney, Agent, or Firm* — John J. Elnitski, Jr.

(57) ABSTRACT

An antenna assembly including an antenna, an antenna cable, a bendable structure, a housing interface, a first protection section and a second protection section. The bendable structure is a malleable material that remains in a bent position when bent. The first protection section covers the antenna and provides a weatherproof cover over the antenna. The housing interface mounts to a housing and covers the antenna cable in an area of the antenna cable adapted to enter the housing and the housing interface prior to entrance providing a weatherproof cover over the area of the antenna cable adapted to enter the housing. The second protection section is overmolded over a portion of the housing interface, the antenna cable, the bendable structure and a portion of the first protection. The second protection section is a flexible material.

12 Claims, 5 Drawing Sheets

FLEXIBLE ANTENNA WITH WEATHERPROOF PROTECTION SYSTEM AND METHOD OF WEATHER PROOFING AND ADDING A FLEXIBLE FEATURE TO EXISTING ANTENNAS

BACKGROUND

The present invention generally relates to antennas. More specifically, the present invention relates to flexible RF antennas with weather protection.

Standard adjustable antennas typically do not have a robust weatherproof interface between the antenna and the mounting location of the antenna. The mounting location can be anything from an electronic box to a vehicle. For simplicity, the mounting location will be referred to as a housing. One reason is that there is a lack of a robust weatherproof interface is the difficulty to design a weatherproof product using an off-the-shelf antenna that has already been designed for a specific purpose. A second reason might be that there is not a significant demand to produce such an antenna in flexible weatherproof version. Another issue with most adjustable antennas is it that the antenna design does not have a 3-dimensional flexible joint and only allows for rotation along one axis. Whereby, if the antenna is struck by accident, the antenna may transfer a large impact load to the housing or the antenna connector, potentially damaging the housing or antenna connector.

It is an object of the present invention to provide a weatherproof antenna that flexible in all directions, so the antenna does not transfer impact loads to the housing.

SUMMARY OF THE INVENTION

An antenna assembly including an antenna, an antenna cable, a bendable structure, a housing interface, a first protection section and a second protection section. The bendable structure is a malleable material that remains in a bent position when bent. The first protection section covers the antenna and provides a weatherproof cover over the antenna. The housing interface mounts to a housing and covers the antenna cable in an area of the antenna cable adapted to enter the housing and the housing interface prior to entrance providing a weatherproof cover over the area of the antenna cable adapted to enter the housing. The second protection section is overmolded over a portion of the housing interface, the antenna cable, the bendable structure and a portion of the first protection. The second protection section is a flexible material.

DETAILED DESCRIPTION

Figure 1:
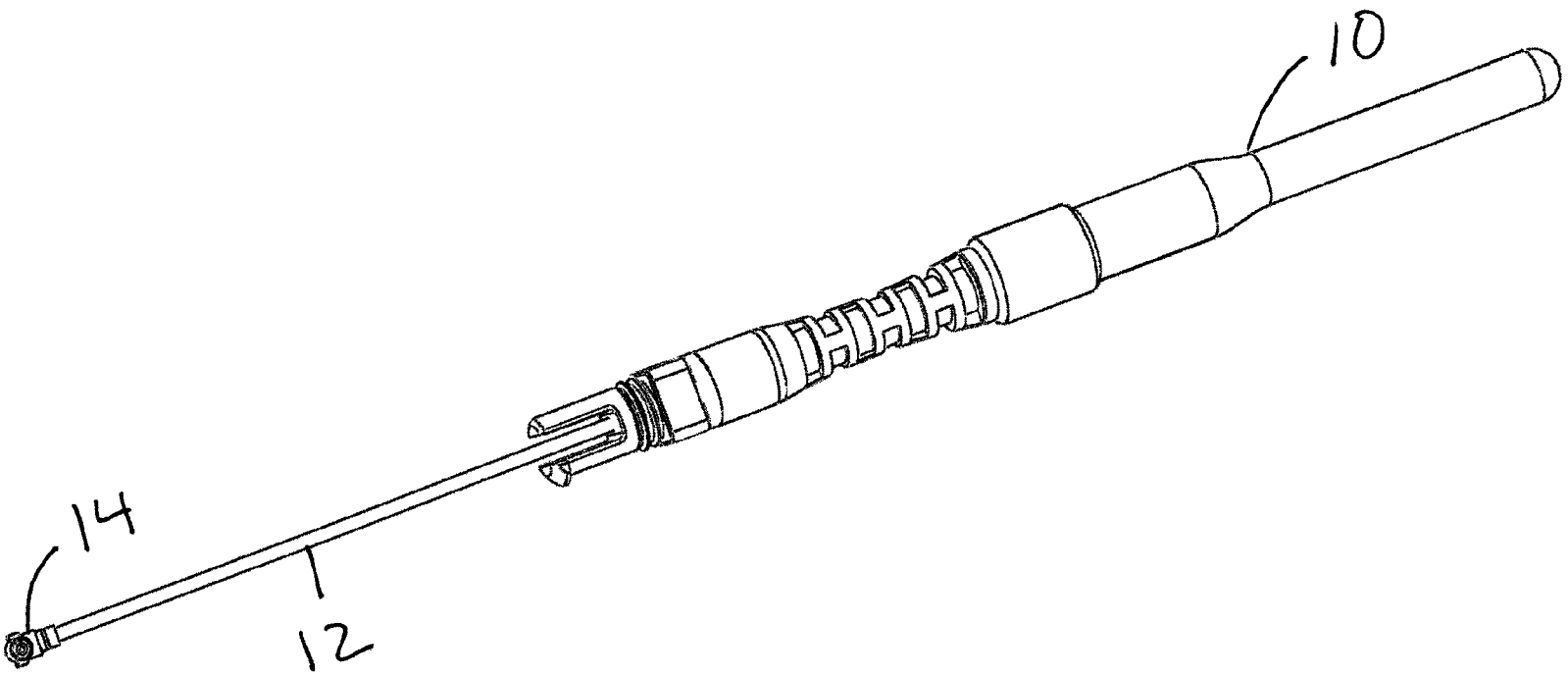
FIG. 1 is a perspective view of a flexible antenna with a waterproof protection system according to the present invention.

The present invention is a flexible antenna with a waterproof protection system for attachment to a housing, as shown in FIG. 1. The present invention also includes the method of weatherproofing an existing antenna, while adding a flexible feature to the antenna. Examples of housings are electronic boxes or vehicles. FIG. 1 shows the complete waterproof protection system using an off the shelf antenna 10 and coaxial cable 12. The coaxial cable 12 is an RF cable that includes the usual RF connector 14 to be connected to a radio within the housing. The coaxial cable 12 extending from the waterproof protection system along with the RF connector 14 is to be inserted inside the housing.

Figure 2:
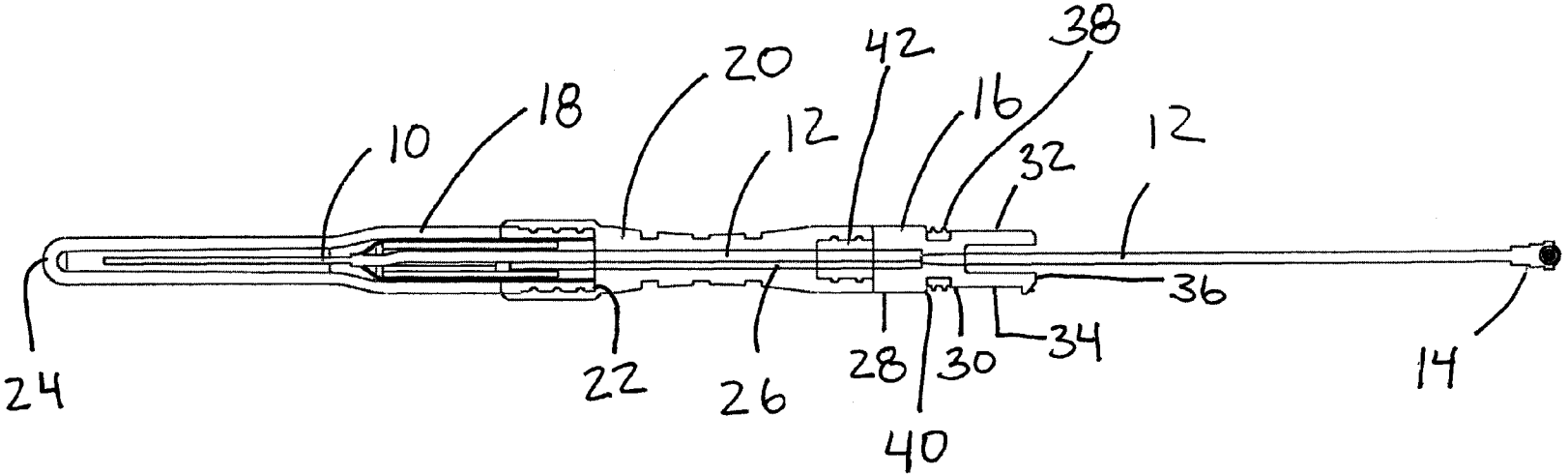
FIG. 2 is a cutaway view of a flexible antenna with a waterproof protection system according to the present invention.

FIG. 2 shows a cutaway view of the waterproof protection system. The waterproof protection system includes a housing interface 16, a first protection section 18 and a second protection section 20. The first protection section 18 includes the antenna 10 mounted within the first protection section 18. The first protection section 18 has an antenna shape where it reduces in diameter from a bottom end 22 to a top end 24. FIG. 2 shows the coaxial cable 12 traveling through the housing interface 16, the second protection section 20 and the first protection section 18. The coaxial cable 12 is connected to the antenna 10 in the first protection section 18. FIG. 2 also shows a bendable wire 26 acting as a bendable structure that runs along the coaxial cable 12 in the second protection section 20 and extends into both the housing interface 16 and the first protection section 18.

Figure 3:
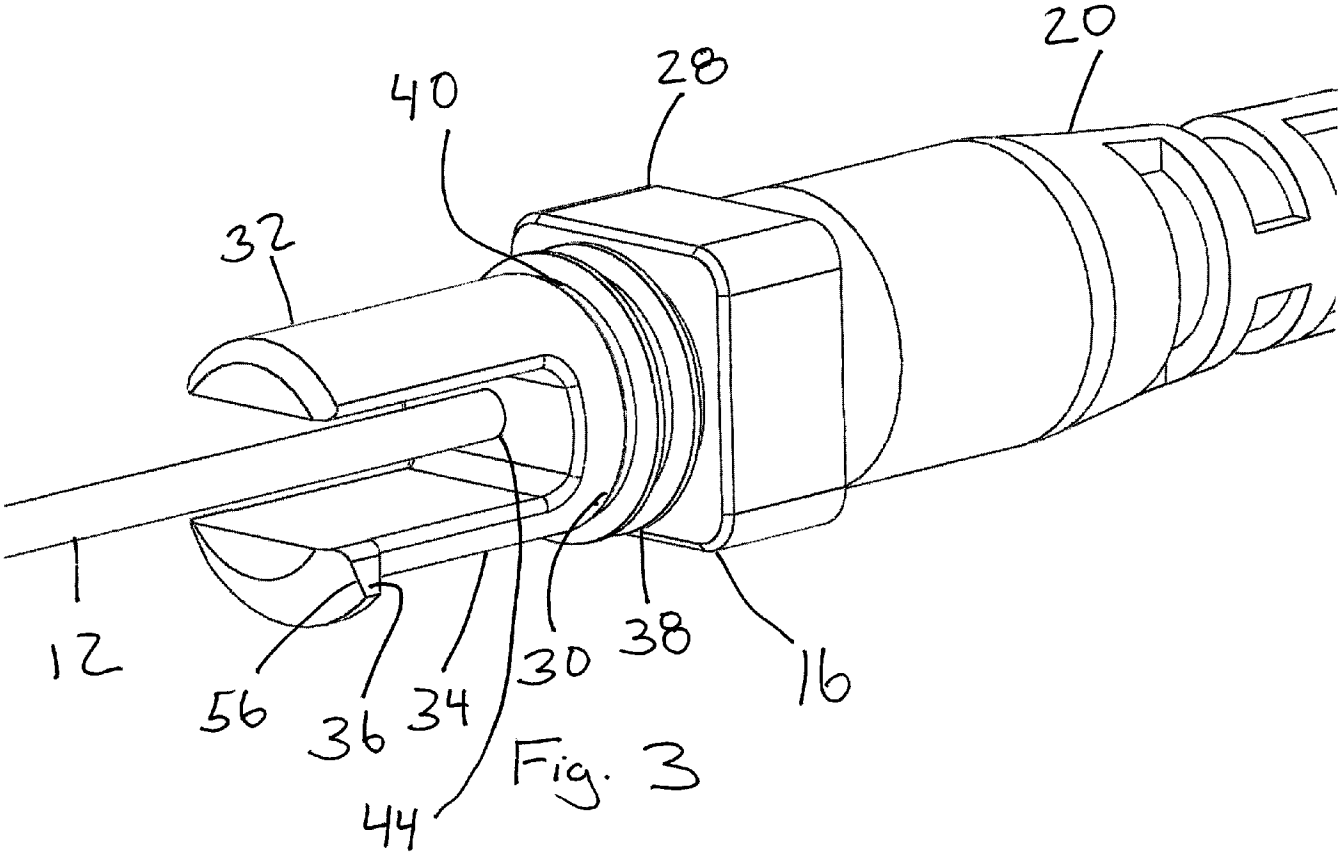
FIG. 3 is a perspective view of a housing interface according to the present invention.
Figure 4:
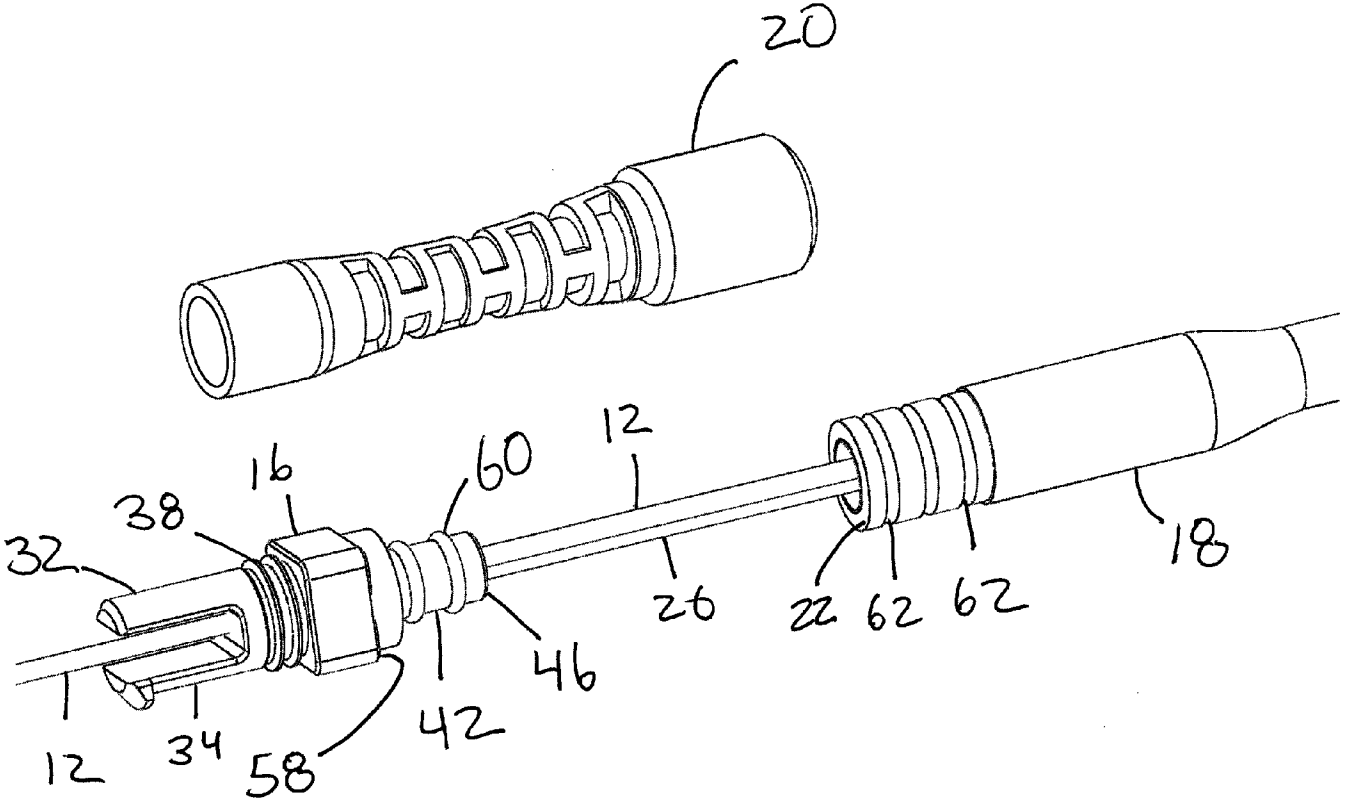
FIG. 4 is a perspective view of a flexible antenna with a waterproof protection system to the present invention.
Figure 5:
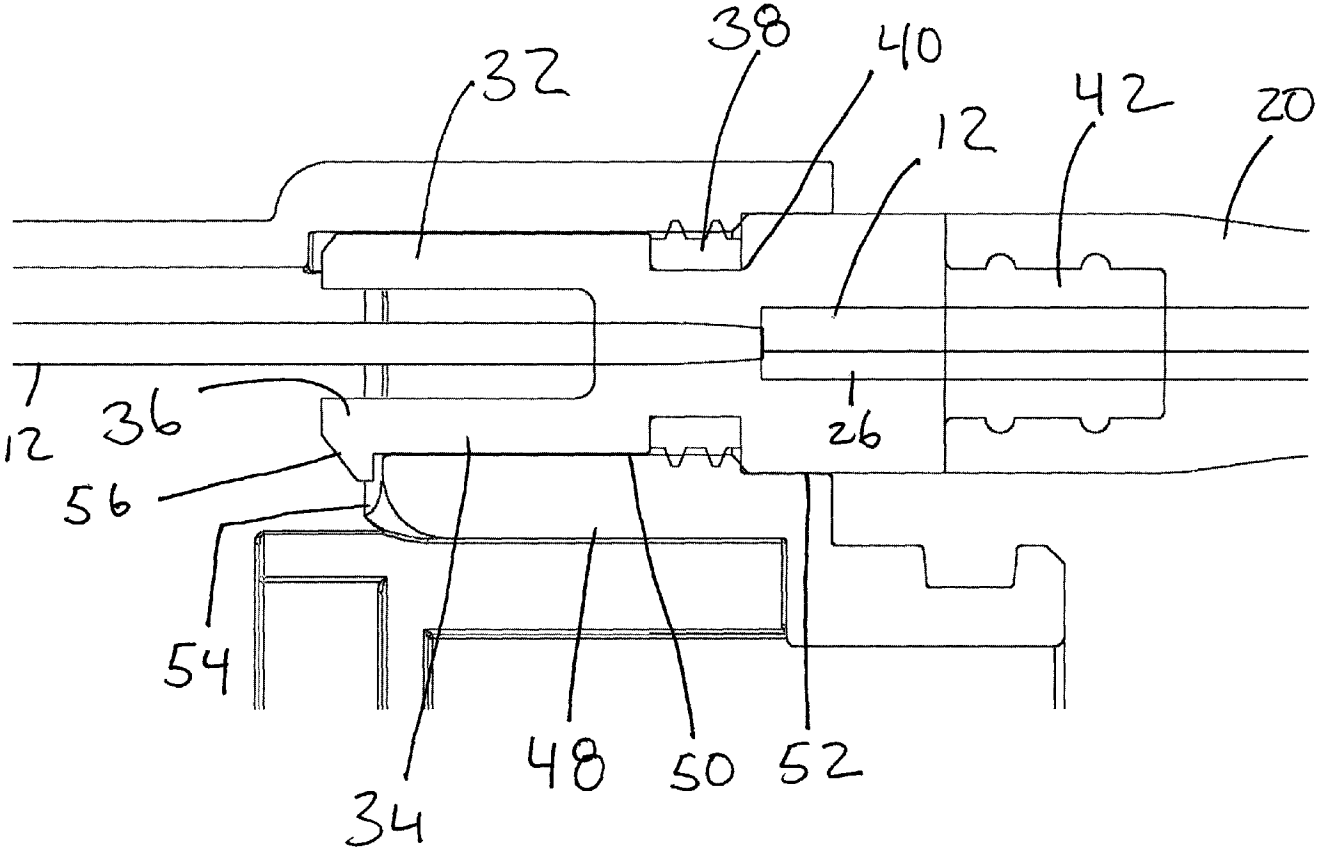
FIG. 5 is a cutaway view of a housing interface mounted in a housing according to the present invention.

The housing interface 16 includes a top end 28 and a bottom end 30, as shown in FIGS. 3-5. The bottom end 30 includes a straight tab 32 and a spring tab 34 extending from the bottom end 30. The spring tab 32 includes a snap catch 36. A seal 38 is mounted in a seal groove 40 around the bottom end 30. The top end 28 is square shaped with an internal port 42 extending from the top end 28. The bottom end 30, top end 28 and internal port 42 form a continuous sealed body. There is a cable through hole 44 which runs from the bottom end 30 through to the end 46 of the internal port 42 to allow the coaxial cable 12 to run from between the tabs 32, 34, through the bottom end 30 and the top end 30, and exiting out the internal port 42. FIG. 5 shows a housing 48 having a round entrance channel 50 leading from a square shaped external port 52. The entrance channel 50 includes an internal shoulder 54 on the end opposite the external port 52. The housing interface 16 provides for the attachment of the flexible antenna to the housing 48. The housing interface 16 is inserted into the external port 52 with the coaxial cable 12 leading the way. The spring tab 34 bends towards the coaxial cable 12 during insertion into the entrance channel 50. The snap catch 36 includes an angle cut end 56 to ease insertion of the straight tab 32 and spring tab 34 in to the entrance channel 50. Once the snap catch 36 clears the internal shoulder 54, the spring tab 34 releases and springs back to its natural state. The snap catch 36 then catches on the internal shoulder 54 to lock the housing interface 16 to the housing 48. During insertion, the square shape of the top end 30 of the housing interface 16 engages the squared shaped port 52 of the housing 48 to further lock the housing interface 16 in position to prevent rotation of the housing interface 16 and hence the antenna 10. Other non-circular shapes for the top end 30 and the port 52 can be used, for example a triangle or hexagon, where there is a corner to prevent rotation. The seal 38 is used to seal the entrance channel 50 near the squared shaped port 52 to provide weather proofing at the housing opening.

The method of sealing an off the shelf antenna with an attached coaxial cable 12 is as follows. Assemble the Dipole antenna 10, coaxial cable 12 and RF connector 14. The housing interface 16 is overmolded about the coaxial cable 12 and the bendable wire 26, so that the housing interface 16 is a sealed one piece unit. Where the process of overmolding is the molding of a material over a structure, in order to seal about the structure using the material used in the overmolding process. It is preferable that the housing interface 16 is of a harder plastic for strength and the seal 38 is slipped on afterwards. This also locks the coaxial cable 12 and bendable wire 26 in position at the housing interface 16. The first protection section 18 is an overmold that is slid over the end of the antenna 10 to cover the antenna 10, part of the coaxial cable 12 and part of the bendable wire 26. The first protection section 18 can be of hard or soft materials. The second protection section 20 is overmolded over the remaining exposed section between the housing interface 16 and the first protection section 18. The remaining exposed section includes a top face 58 of the housing interface 16, the internal port 42 extending from the housing interface 16, coaxial cable 12, bendable wire 26, and the bottom end 22 of the first protection section 18. The internal port 42 of the housing interface 16 is shown with ribbing 60 to provide a gripping surface for the overmold of the second protection section 20. The first protection section 18 includes grooves 62 near bottom end 22 to form ribbing between the grooves 62 to provide gripping surface for the overmold of the second protection section 20. The second protection section 20 provides the seal between the housing interface 16 and the first protection section 18 by covering the top end 28 of the housing interface 16 and the bottom end 22 of the first protection section 18. The second protection section 20 is of a flexible rubber material to allow for bending along the second protection section 20. The flexible rubber allows strain-relieved bending of the bendable wire 26 which runs alongside the coaxial cable 12. The flexible rubber provides the strain relief to prevent the bendable wire 26 from kinking, yet allow the coaxial cable 12 to be bent to whatever angle is desired to allow the antenna 10 to point in a particular direction. The bendable wire 26 is preferably copper, which is a metal that has memory characteristics. Bendable wire 26 is a wire that is malleable and has memory characteristics is able to hold the coaxial cable 12 at the desired bend angle. The bendable wire 26 could be replaced by having a bendable coaxial cable with memory characteristics, though it is more costly then the regular coaxial cable 12 and bendable wire 26.

The flexible antenna with a waterproof protection system and method of making it provides an infinitely adjustable flexible joint with a copper memory element to hold desired bend angle; a strain-relieved bending joint and good impact protection to the parent housing since antenna is flexible and does not transfer antenna impacts loads to housing.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

We claim:

1. An antenna assembly for attachment to a housing, comprising:

an antenna;

an antenna cable connected to said antenna adapted to provide a connection between said antenna and a radio in the housing;

a bendable structure along said antenna cable, said bendable structure of a malleable material that remains in a bent position when said bendable structure is bent into a desired bent configuration;

a first protection section to cover said antenna and said connection between said antenna and said antenna cable, said first protection section providing a weatherproof cover over said antenna and said antenna cable;

a housing interface adapted to mount to the housing, said housing interface covering said antenna cable in an area of said antenna cable adapted to enter the housing and said housing interface prior to entrance providing a weatherproof cover over said area of said antenna cable adapted to enter the housing;

a second protection section having a length, said second protection section is overmolded over a portion of said housing interface, said antenna cable, said bendable structure and a portion of said first protection section to provide a weatherproof seal over said antenna cable and said bendable structure exposed between said housing interface and said first protection section, said second protection section being of a flexible material so said second protection section can bend along said length of said second protection section, said second protection section trapping said bendable structure near said antenna cable so said antenna cable bends when said bendable structure is bent along said second protection section.

2. The antenna assembly of claim 1, wherein said bendable structure extends into said housing interface with said antenna cable and extends into said first protection section with said antenna cable.

3. The antenna assembly of claim 1, wherein said bendable structure is a wire.

4. The antenna assembly of claim 1, wherein said bendable structure contacts said antenna cable.

5. The antenna assembly of claim 1, wherein said housing interface includes a top end and a bottom end, said top end having at least one corner adapted to catch a corner on the housing to prevent rotation of said housing interface at the housing.

6. The antenna assembly of claim 5, wherein said top end of said housing interface is a square shape.

7. The antenna assembly of claim 5, wherein said bottom end of said housing interface includes a spring tab adapted to lock said housing interface to the housing.

8. The antenna assembly of claim 5, wherein said bottom end includes a seal adapted to provide a seal between said housing interface and the housing.

9. The antenna assembly of claim 5, wherein said top end of said housing interface includes an internal port to provide a surface for said material of said second protection section to adhere to when overmolded.

10. The antenna assembly of claim 9, wherein said internal port includes ribbing to provide additional surfaces for said material of said second protection section to adhere to when overmolded.

11. The antenna assembly of claim 1, wherein said first protection section includes grooving to provide additional surfaces for said material of said second protection section to adhere to when overmolded.

12. The method of converting an antenna and antenna cable to a flexible weatherproofed antenna system, comprising:

aligning a bendable structure with the antenna cable, where the bendable structure of a malleable material that remains in a bent position when the bendable structure is bent into a desired bent configuration;

sliding a first protection section over an end of the antenna to cover the antenna, part of the coaxial cable and part of the bendable structure, where the first protection section covers a connection between the antenna and antenna cable, and where the first protection section provides a weatherproof cover over the antenna and the antenna cable;

overmolding a housing interface about part of the antenna cable and part of the bendable structure, so that the housing interface is a sealed one piece unit;

overmolding a second protection section over a remaining exposed section between the housing interface and the first protection section which includes a top face of the housing interface, an internal port extending from the housing interface, the coaxial cable, the bendable structure, and a bottom end of the first protection section, where the second protection section provides a weatherproof seal over the antenna cable and the bendable structure exposed between the housing interface and the first protection section, where the second protection section being of a flexible material so the second protection section can bend along the length of the second protection section and held in place due to trapping the bendable structure near the antenna cable so the antenna cable bends when the bendable structure is bent along the second protection section.

* * * * *